United States Patent [19]

Boyle

[11] 4,041,480

[45] Aug. 9, 1977

[54] DISPENSER COVER AND INDICATOR

[76] Inventor: James Boyle, 358 Maple Glen Ridge, Pomona, N.Y. 10970

[21] Appl. No.: 667,571

[22] Filed: Mar. 17, 1976

[51] Int. Cl.[2] ..... G08B 21/00

[52] U.S. Cl. ..... 340/280; 200/61.15; 200/61.2; 200/85 R; 340/272

[58] Field of Search ..... 340/272, 280, 283, 244 D, 340/246, 247; 200/61.15, 61.17, 61.18, 61.2, 61.21, 61.83, 85 R; 221/9, 10

[56] References Cited

U.S. PATENT DOCUMENTS 3,631,538 12/1971 Kohn ..... 340/283

*Primary Examiner*—Glen R. Swann, III

*Attorney, Agent, or Firm*—Robert D. Farkas

[57] ABSTRACT

A cover for a cup dispenser includes an indicating device which provides a warning when the dispenser is nearly empty. A weight at the end of a spring controlled wire reel mounted in the cover is placed in the uppermost cup and moves down as cups are dispensed. At a predetermined distance of travel of the wire and weight, a microswitch is actuated which connects a battery to turn on a light bulb or other warning or indicator device on the cover. When a new supply of cups is inserted, the weight is lifted and the spring rewinds the wire and opens the switch connecting the light and battery.

3 Claims, 4 Drawing Figures

DISPENSER COVER AND INDICATOR

BACKGROUND OF THE INVENTION

1. Field of the Invention

The present invention relates to a cup dispenser cover and particularly to a cover which indicates that the supply of cups is low.

2. Description of the Prior Art

Paper cup dispensers are generally unattractive and decorative covers are used to provide an improved appearance. The covers, however, block the view of the inner dispenser so that it is difficult to determine how many cups remain and when the supply should be replenished. One known device for dispensing and indicating the level of articles in a container includes a plunger or follower which is manually pushed down to release articles from a bottom opening. When the plunger reaches the bottom, a new supply is added. Such a device is shown in U.S. Pat. No. 3,392,878 issued July 16, 1968. This device would be unwieldy and difficult to use with a cup dispenser.

SUMMARY OF THE INVENTION

It is therefore the primary object of the present invention to provide an indicator device for a cup dispenser cover which is simple and effective in indicating at a distance from the dispenser that the supply of cups is low.

This is accomplished with a weight and reel mechanism which are mounted within the cover above the supply of cups. A spring controlled wire reel has a weight attached to the end and placed in the uppermost cup. As the supply diminishes, the weight moves down with the cup until, at a set distance, a microswitch contact is actuated which connects a battery to light a small lamp on the outside of the cover. The lamp and switch are turned off when a new supply of cups is inserted to raise the weight and reel. Other objects and advantages will become apparent from the following description in conjunction with the accompanying drawings.

DESCRIPTION OF THE PREFERRED EMBODIMENT

Figure 1:
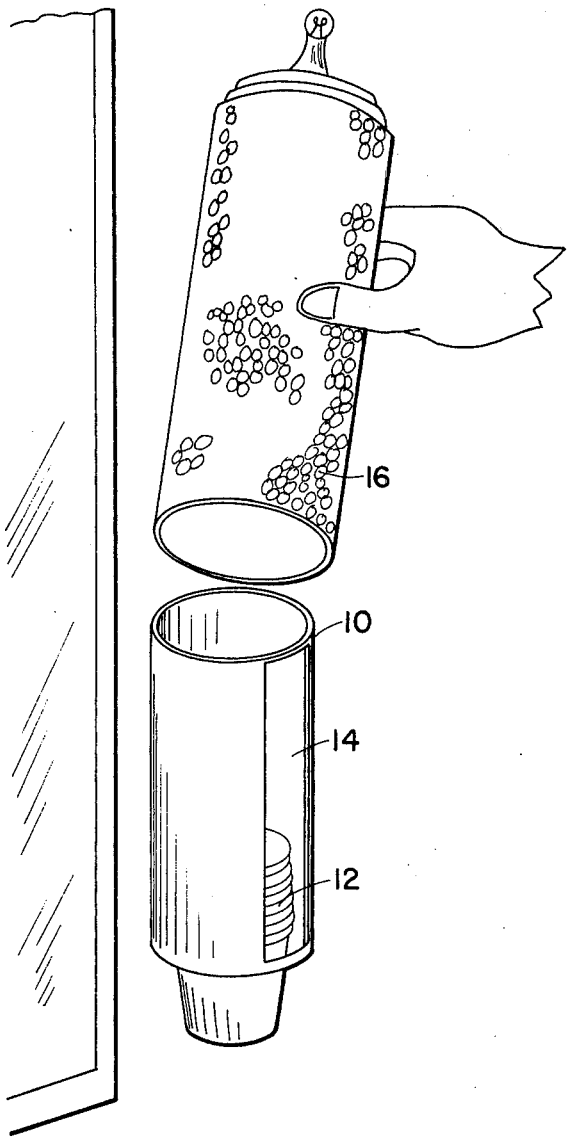
FIG 1. is a pictorial representation of the cover and dispenser.

As shown in FIG. 1, a container 10 for dispensing paper or plastic cups 12, includes a transparent window 14, through which the supply of cups is seen. A decorative cylindrical cover 16 may be placed over the container to provide a more attractive appearance. The cover, however, blocks the view of the cups to make it difficult to ascertain when the dispenser requires a new supply.

Figure 2:
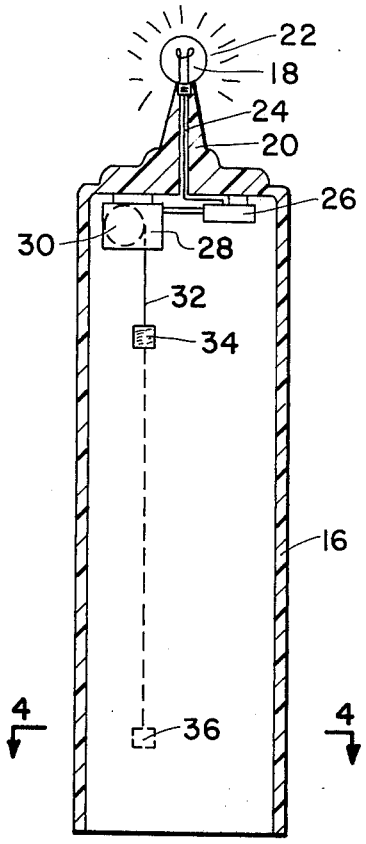
FIG. 2 is a cross-section of the cover showing the indicator device.

This problem is overcome by use of an indicator mechanism as shown in FIG. 2. A small direct current operated light bulb 18 is mounted on the top of a conical support 20 on the upper surface of cover 16. The bulb may be enclosed in a globe or filter 22 to provide light of a desired color. The bulb is connected by a wire 24 through the cover to a battery 26 and microswitch 28 which are secured to the inside of the cover 16. A spring controlled reel 30 is mounted adjacent the switch 28 to raise and lower a wound wire 32. A weight 34 is attached to the end of the wire.

In operation, the weight is placed in the uppermost cup within the container 10 when the cover is placed over the dispenser. As cups are used, the weight continuously moves down with the last cup. When the weight and end of the wire are down to a predetermined position 36, a cam, or other suitable linkage on reel 30 actuates the contact of microswitch 28 to close the circuit between the battery 26 and filament of the light bulb 18 and turn on the indicator light. This can readily be seen at a distance from the dispenser and a new supply of cups can then be inserted upon removing the cover. When the cover is replaced over the dispenser, the weight is again positioned in the upper cup and the slack wire is automatically rewound onto the spring controlled reel. This causes the reel linkage to open the microswitch and battery circuit and turn off the light until the next time the cups require replenishing. The distance at which the reel linkage closes the circuit can be calibrated to determine the desired warning point. For example, this can be when only one or two cups remain or when the last cup is used.

Figure 3:
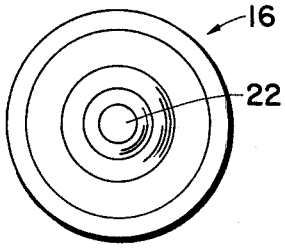
FIG. 3 is a top view of the cover.
Figure 4:
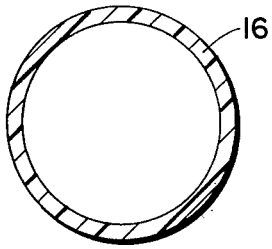
FIG. 4 is a top cross-sectional view of the cover.

FIGS. 3 and 4 respectively show views of the cover from the top and a cross-section through line 4—4 of FIG. 2. The upper portion of the cover is preferably of a suitable plastic material to provide insulation for the electrical circuit. The lower portion may also be of the same plastic of bright decorative colors, or of a thin metal or added metallic coating, which can include attractive designs on the exterior surface. Instead of an indicator light, the warning signal may be provided by another suitable device such as a buzzer. While only a single embodiment has been illustrated and fully described, it is apparent that many variations may be made in the particular design and configuration without departing from the scope of the invention as set forth in the appended claims.

What is claimed is:

1. An indicating device for a cup dispenser comprising:

a. a cover adapted to enclose a cup dispenser containing a plurality of vertically stacked removable cups therein;

b. sensing means secured within said cover to an upper surface for sensing the distance between the uppermost cup and a lower reference point, c. indicator means secured to said cover to indicate when said uppermost cup reaches said lower reference point; and d. switching means actuated by said sensing means to switch on said indicator means when said uppermost cup reaches said reference point, said sensing means including a spring controlled reel, a length of wire wound on said reel, a weight secured to the end of said wire, said weight being adapted to rest on said uppermost cup and move with said uppermost cup to pull said wire from said reel as said uppermost cup moves down said stack, and means for actuating said switching means when said length of wire and weight reach said reference point, said reel rewinding said wire when said weight is lifted above said reference point to deactivate said switching means and turn off said indicator means.

2. The device of claim 1 wherein said switching means includes a switch secured within said cover to an upper surface, and a source of direct voltage for said indicator means, said switch coupling said source to said indicator means when said wire and weight reach said reference point.

3. The device of claim 2 wherein said indicator means is a light bulb secured to an outer surface of said cover and coupled through said cover to said direct voltage source and switch.

* * * * *